US009175513B2

(12) United States Patent
Dawdy

(10) Patent No.: US 9,175,513 B2
(45) **Date of Patent: *Nov. 3, 2015**

(54) FIRE DOOR METHOD OF OPERATION

(71) Applicant: CIW Enterprises, Inc., Mountaintop, PA (US)

(72) Inventor: David Dawdy, Mountaintop, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/195,760

(22) Filed: Mar. 3, 2014

(65) Prior Publication Data

US 2014/0246154 A1 Sep. 4, 2014

Related U.S. Application Data

(60) Provisional application No. 61/772,086, filed on Mar. 4, 2013.

(51) Int. Cl.

| | |
|---|---|
| ***E05F 15/20*** | (2006.01) |
| ***E06B 9/68*** | (2006.01) |
| ***A62C 2/10*** | (2006.01) |
| ***E05F 15/72*** | (2015.01) |
| ***A62C 2/24*** | (2006.01) |
| *E06B 5/16* | (2006.01) |

(52) U.S. Cl.

CPC ... *E06B 9/68* (2013.01); *A62C 2/10* (2013.01); *A62C 2/24* (2013.01); *E05F 15/72* (2015.01); *E05Y 2900/00* (2013.01); *E05Y 2900/106* (2013.01); *E06B 5/16* (2013.01); *E06B 2009/6818* (2013.01)

(58) Field of Classification Search

CPC ..... E06B 9/68; E06B 5/16; E05F 15/72; E05F 1/006

USPC ..... 160/1, 6, 7, 8, 9, 405, 310

See application file for complete search history.

(56) References Cited

U.S. PATENT DOCUMENTS

| | | | | | |
|---|---|---|---|---|---|
| 3,559,716 | A * | 2/1971 | Loucks | 160/9 |
| 4,130,156 | A * | 12/1978 | Wardlaw | 160/9 |
| 4,338,526 | A * | 7/1982 | Martin et al. | 307/116 |
| 5,203,392 | A * | 4/1993 | Shea | 160/7 |
| 5,576,581 | A * | 11/1996 | Iannuzzi et al. | 307/117 |
| 5,896,907 | A * | 4/1999 | Dever et al. | 160/6 |
| 6,079,162 | A * | 6/2000 | Hein | 52/1 |
| 6,155,324 | A * | 12/2000 | Elliott et al. | 160/1 |
| 6,484,784 | B1 * | 11/2002 | Weik et al. | 160/7 |
| 6,515,377 | B1 * | 2/2003 | Ubelein et al. | 307/10.1 |
| 7,299,847 | B1 * | 11/2007 | Evans | 160/1 |
| 7,343,958 | B1 * | 3/2008 | East et al. | 160/191 |
| 7,878,230 | B2 * | 2/2011 | Daus et al. | 160/9 |
| 8,037,922 | B2 * | 10/2011 | Hawkins et al. | 160/310 |
| 8,069,896 | B2 * | 12/2011 | Magro | 160/1 |
| 8,397,787 | B1 * | 3/2013 | Daus et al. | 160/9 |
| 8,567,573 | B2 * | 10/2013 | Hsieh | 188/156 |
| 8,651,164 | B2 * | 2/2014 | Klish et al. | 160/7 |
| 8,806,806 | B2 * | 8/2014 | Leivenzon et al. | 49/140 |
| 8,905,113 | B2 * | 12/2014 | Daus et al. | 160/9 |
| 9,013,059 | B2 * | 4/2015 | Altonen et al. | 307/31 |
| 2010/0242364 | A1 * | 9/2010 | Magro | 49/31 |
| 2010/0243175 | A1 * | 9/2010 | Gonzales et al. | 160/7 |
| 2012/0216462 | A1 * | 8/2012 | Klish et al. | 49/506 |
| 2013/0228289 | A1 | 9/2013 | Klish et al. | |
| 2014/0305599 | A1 * | 10/2014 | Pimenov | 160/7 |
| 2014/0305600 | A1 * | 10/2014 | Casey et al. | 160/127 |
| 2014/0318719 | A1 * | 10/2014 | Hsieh | 160/133 |
| 2014/0345812 | A1 * | 11/2014 | Casey et al. | 160/273.1 |

* cited by examiner

*Primary Examiner* — Katherine Mitchell

*Assistant Examiner* — Johnnie A Shablack

(74) *Attorney, Agent, or Firm* — Mitchell A. Smolow

(57) ABSTRACT

The present invention presents a method to permit emergency egress through an access opening covered by an overhead coiling fire door. Upon receiving an alarm notification from a first detector located on one side of the access opening the door is power closed to a predetermined height and held there for the predetermined time, then power closed to a fully closed position. Upon receiving a second alarm notification from a second detector located on the opposite side of the access opening the door enters into a secondary alarm condition. The door is power closed and awaits notification to initiate a secondary emergency egress sequence. The secondary emergency egress sequence comprises receiving a door opening notification, opening the door, holding the door open for a predetermined time, and reclosing the door. Upon primary power restoration or a return to a non-alarm condition the door returns to its preset open position.

17 Claims, No Drawings

FIRE DOOR METHOD OF OPERATION

CROSS REFERENCE TO RELATED APPLICATIONS

This application claims benefit of U.S. Provisional Application No. 61/772,086 filed Mar. 4, 2013.

FIELD OF THE INVENTION

This invention relates generally to emergency egress and in particular, to a method of creating emergency egress at a fire and smoke barrier.

BACKGROUND OF THE INVENTION

By code, buildings such as industrial, school and public buildings require fire and smoke barrier opening protectives. They also require emergency egress capability. Due to the simplistic operation and known designs of swing door exit hardware, side-hinged swinging doors are commonly used to simultaneously accomplish both.

However, side-hinged swinging doors are not always the desired design choice to meet code requirements. For structures needing higher occupancy load egress and fire and smoke protection requirements, multiple swing doors and/or banks of swing doors and their associated frame assemblies are used. The framing requirements of multiple doors and/or banks of doors present architectural challenges for building designers.

In an attempt to overcome these challenges, a variety of door designs have been developed. One known design uses up to two swinging fire door and frame assemblies that store in pockets perpendicular to the opening. A second known design includes a bank of swinging fire door and frame assemblies that are attached to the bottom of a coiling door. Although these designs include commonly accepted side-hinge swinging doors, they require significantly more head or side room clearances and cost more to manufacture than earlier designs.

Another known design uses commonly accepted side-hinge swinging doors in an accordion folding fire door configuration. However, this design requires side stack space for the folded accordion door and non-folding side-hinge swinging door(s). Because occupancy load determines the amount of door opening/number of required doors, each required side-hinge swinging door mandates additional side stack space, thereby reducing the overall free space and presenting construction challenges.

Still another known design uses accordion folding fire doors with an integral DC power supply and curtain mounted egress activation hardware that causes electric opening of the door for egress. These doors mandate ample side room to store the accordion folding fire door and operating system.

Overhead coiling fire doors have been developed to overcome the aforementioned challenges. The overhead coiling fire door is provided with an operator that will run the door under both normal condition and during a fire and smoke alarm condition ideally at an established average door speed. Such configurations allow building designers the ability to reduce the construction costs and aesthetic problems associated with numerous banks of fire/emergency egress doors.

Because the overhead coiling fire door utilizes a powered operator, battery backup is employed to maintain operational capability during a power failure. There remains a continuing need for improved methods of providing overhead coiling door emergency egress during a fire and smoke alarm condition. The present invention fulfills this need and further provides related advantages.

BRIEF SUMMARY OF THE INVENTION

The present invention presents a method to permit emergency egress through an access opening covered by an overhead coiling fire door.

A preset time delay to initiate door closure upon alarm notification, a preset time to hold the door at an open position before full closure, and a preset time to re-close the door after alarm sequence activation are determined. A backup power supply is monitored for backup power loss; audible and/or visual notification is provided at a predetermined loss level.

At a predetermined backup power loss level the door is power closed to a default closed position, and at a second predetermined backup power loss level a power drive disconnects allowing manual opening of the door.

Upon receiving an alarm notification from a first detector located on one side of the access opening the door is power closed to a predetermined height and held there for the predetermined time, then power closed to a fully closed position. When on backup battery power, the backup battery is capable of providing an emergency egress sequence for a predetermined minimum number of cycles. The emergency egress sequence comprises receiving a door opening notification, opening the door, holding the door open for the predetermined time, and reclosing the door.

Upon receiving a second alarm notification from a second detector located on the opposite side of the access opening, the door enters into a secondary alarm condition. The door is power closed and awaits notification to initiate a secondary emergency egress sequence. The secondary emergency egress sequence comprises receiving a door opening notification, opening the door, holding the door open for the predetermined time, and reclosing the door.

Upon primary power restoration or a return to a non-alarm condition the door returns to its present open position.

Other features and advantages of the present invention will be apparent from the following more detailed description of the preferred embodiments which illustrate by way of example the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. As used herein:

OCFD shall mean "overhead coiling fire door", however the method described below is not limited to use with fire doors.

FACP shall mean "fire alarm control panel".

NFPA shall mean "National Fire Protection Association".

AHJ shall mean "an organization, office or individual responsible for enforcing the requirements of a code or standard, or for approving equipment, materials, an installation or a procedure".

Emergency egress cycle shall mean a powered opening of the OCFD to a preset height, pausing the OCFD at the preset height for a preset time, then power closing the OCFD.

In a powered, non-alarm condition the OCFD is in a powered, non-alarm default position, preferably fully open. Power is provided by either a primary power supply system, for example, the electric utility power supply or a power supply backup system, for example, a backup battery system.

The power supply is monitored, preferably continuously monitored, to detect power supply aberrations, for example, drops and variations in the electric utility power supply and/or a voltage drop of the backup battery system.

The OCFD and its alarm condition detectors (describe below) are in communication with the building FACP, preferably directly connected to the FACP, to provide notification to the FACP of an alarm condition, for example, a fire event.

The power supply backup system is configured to provide operative power to the OCFD for a predetermined number of emergency egress cycles during a primary power interruption of a predetermined duration. It is configured to provide a minimum number of emergency egress cycles in the absence of primary power, for example, the backup battery system is provided to maintain the capability to power a minimum of fifty emergency egress cycles after a power interruption of 24 hours.

When in a non-alarm condition the power supply backup system reaches a power state loss level capable of operating no more than a preset minimum number of emergency egress cycles, notification is sent, for example, a warning horn will sound. The notification allows for preemptive reestablishment of a fully operational power state, for example, by replacing the backup battery. If the power supply backup system fully operational power state is not timely reestablished, at a preset critical level of backup system discharge, the OCFD enters into an activation mode.

Upon a primary power supply failure during a non-alarm condition the OCFD is configured to remain in the powered, non-alarm default position, preferably a fully open position until such time as either primary power is restored, the OCFD receives notification to activate an alarm sequence of operation (activation mode), or the power supply backup system deteriorates to a pre-determined power state level, thereafter entering into the activation mode.

A local alarm condition detector, for example, a smoke and heat detector, is positioned on each side of the access opening and each is in communication with the FACP. Preferably the alarm condition detectors are mounted per NFPA 72, incorporated by reference. When an alarm condition detector detects an alarm condition, for example, combustion, notification is communicated to the FACP and the OCFD is notified to enter into an alarm condition mode and activate the alarm sequence of operation.

Upon receiving an initial notification to activate (by either a local alarm condition detector or the FACP) the alarm sequence of operation begins. The alarm sequence of operation comprises:

Powering the OCFD to a preset height below the ceiling. Preferably the height is about 24 inches below the ceiling but not lower than about 80 inches, the ADA minimum specified height. Power may be supplied by either the primary or backup power supply.

Keeping the OCFD at the preset height for a preset delay time. The preset delay time is set, for example, between about 0 minutes and about 60 minutes as per the AHJ and site requirements. Preferably the preset delay time is about 20 minutes, sufficient to permit full width emergency egress.

Power closing the OCFD to the floor upon expiration of the preset delay time. As previously described, if the primary power supply is unavailable, the power supply backup system provides a preset minimum number of emergency egress cycles.

If primary power remains unavailable, after completing a preset number of emergency egress cycles under backup power, preferably a minimum of fifty emergency egress cycles, a power drive disconnects from the closed OCFD, thereby permitting the OCFD to be manually opened, for example by lifting a bottom bar handle, to provide full width escapement capability. Preferably, the lifting effort is no greater than about 15 pounds of lifting effort. The OCFD is balanced to gravity close to a fully closed position when the power drive is disconnected. Once manually lifted and released, the OCFD returns to a fully closed position.

If at any time during the alarm sequence of operation or during the initial notification preset delay time the second local alarm condition detector also detects combustion the OCFD immediately closes fully to the floor and enters into a fire protection priority mode. This secondary alarm condition detection signifies migration of heat and/or smoke through the access opening and defaults the OCFD closed to the fire protection priority mode, thereafter utilizing a secondary emergency egress cycle.

The secondary emergency egress cycle comprises:

Monitoring a defined detection area on either side of the OCFD for a predefined activity, for example, the presence of activity through motion detectors, or manual initiation of the secondary emergency egress cycle, for example through an activation device, for example, a wall button.

Upon detecting the predefined activity, powering the OCFD to a preset height below the ceiling, preferably about 24 inches below the ceiling. Power may be supplied by either the primary or backup power supply.

Keeping the OCFD at the preset height for a preset delay time, between about 0 seconds and about 60 seconds, preferably about 10 seconds, thereby permitting full width emergency egress.

Power closing the OCFD to the floor upon expiration of the preset delay time. As previously described, if the primary power supply is unavailable, the power supply backup system provides a preset minimum number of secondary emergency egress cycles.

If primary power remains unavailable, after completing a preset number of secondary emergency egress cycles under backup power, preferably a minimum of fifty secondary emergency egress cycles, a power drive disconnects from the closed OCFD, thereby permitting the OCFD to be manually opened, for example by lifting a bottom bar handle, to provide full width escapement capability. The OCFD is balanced to gravity close to a fully closed position when the power drive is disconnected. Once manually lifted and released, the OCFD returns to a fully closed position.

At any time during any sequence of operation, if the alarm condition is cleared the OCFD returns to the non-alarm default position, preferably fully open and returns to a non-alarm condition.

Although the present invention has been described in connection with specific examples and embodiments, those skilled in the art will recognize that it is capable of other variations and modifications within its scope. These examples and embodiments are intended as typical of, rather than in any way limiting on, the scope of the present invention as presented in the appended claims.

What is claimed is:

1. An overhead coiling door method of operation comprising the steps of:

providing a primary power supply to a power operated overhead coiling door;

backing up the primary power supply with a backup power supply;

beginning an alarm sequence of operation upon receiving a notification to activate;

disengaging a powered drive from the door upon the occurrence of a first predetermined event thereby disengaging powered drive operation and allowing manual operation of the door, wherein the door is balanced to gravity close when the powered drive is disengaged; and reconnecting the powered drive upon the occurrence of a second predetermined event;

wherein the alarm sequence of operation comprises powering the door to a preset height, pausing the door at the preset height for a preset time, then power closing the door; the first predetermined event comprises completing a preset number of alarm sequence of operation under backup power; and the second predetermined event comprises restoration of primary power.

2. An overhead coiling door method of operation comprising the steps of:

providing a primary power supply to a power operated overhead coiling door;

backing up the primary power supply with a backup power supply;

establishing communication between a door power operator and a building fire alarm control panel;

placing the door in a non-alarm default position;

monitoring the power supply for power supply aberrations;

beginning an alarm sequence of operation upon receiving a notification to activate;

disengaging a powered drive from the door after a first predetermined event thereby disengaging powered drive operation and allowing manual operation of the door, wherein the door is balanced to gravity close when the powered drive is disengaged; and reconnecting the powered drive upon a second predetermined event;

wherein the alarm sequence of operation comprises powering the door to a preset height, pausing the door at the preset height for a preset time, then power closing the door; the first predetermined event comprises completing a preset number of alarm sequence of operation under backup power; and the second predetermined event comprises restoration of primary power.

3. The method of claim 2 wherein the notification to activate comprises receiving a notification from the building fire alarm control panel.

4. The method of claim 2 wherein the notification to activate comprises receiving a notification that the power supply backup has deteriorated to a pre-determined power state level.

5. An overhead coiling door method of operation comprising the steps of:

providing a primary power supply to a power operated overhead coiling door, the door coving an access opening;

backing up the primary power supply with a backup power supply;

providing a first alarm condition detector on a first side of the access opening and a second alarm condition detector on a second side of the access opening;

establishing communication between a door power operator, the first and second alarm condition detectors, and a building fire alarm control panel;

placing the door in a non-alarm default position;

monitoring the power supply for power supply aberrations;

monitoring the first and second alarm condition detectors for a predefined activity;

beginning an alarm sequence of operation upon receiving a first notification to activate;

beginning a secondary alarm sequence of operation upon receiving a secondary notification;

disengaging a powered drive from the door after a first predetermined event thereby disengaging powered drive operation and allowing manual operation of the door wherein the door is balanced to gravity close when the powered drive is disengaged; and reconnecting the powered drive upon a second predetermined event;

wherein the alarm sequence of operation comprises powering the door to a preset height, pausing the door at the preset height for a first preset time, then power closing the door; and the secondary alarm sequence of operation comprises powering the door to a preset height, pausing the door at the preset height for a second preset time of shorter duration than the first preset time, then power closing the door.

6. The method of claim 5 wherein manual operation of the door requires no greater than about 15 pounds of lifting effort.

7. The method of claim 5 wherein the first predetermined event comprises completing a preset total number of alarm sequence of operation under backup power and secondary alarm sequence of operation under backup power; and the second predetermined event comprises restoration of primary power.

8. The method of claim 7 wherein the alarm sequence of operation comprises powering the door to a preset height, pausing the door at the preset height for a first preset time, then power closing the door; and the secondary alarm sequence of operation comprises powering the door to a preset height, pausing the door at the preset height for a second preset time of shorter duration than the first preset time, then power closing the door.

9. The method of claim 8 wherein the first notification to activate comprises receiving a notification that the power supply backup has deteriorated to a predetermined power state level.

10. The method of claim 8 wherein the first notification to activate comprises receiving a first notification initiated by one of the alarm condition detectors.

11. The method of claim 10 wherein the first notification is initiated by the presence of combustion.

12. The method of claim 8 wherein the first notification to activate comprises receiving a first notification initiated by one of the alarm condition detectors and the secondary notification comprises receiving an additional notification initiated by the second alarm condition detector.

13. The method of claim 12 wherein the first notification is initiated by the presence of combustion.

14. The method of claim 13 wherein the predefined activity comprises motion detection.

15. The method of claim 13 wherein the predefined activity comprises manual initiation.

16. The method of claim 13 wherein the first preset time is between about 0 minutes and about 60 minutes; and the second preset time is between about 0 seconds and about 60 seconds.

17. The method of claim 13 wherein the first preset time is about 20 minutes and the second preset time is about 10 seconds.

* * * * *